US005558606A

United States Patent [19]

Poncini et al.

[11] Patent Number: 5,558,606

[45] Date of Patent: Sep. 24, 1996

[54] FULL CONTRACTION CALF MUSCLE EXERCISER

[76] Inventors: Richard D. Poncini; Paul D. Poncini, both of 402 Foxborough Dr., Mountain View, Calif. 94041

[21] Appl. No.: 271,254

[22] Filed: Jul. 7, 1994

Related U.S. Application Data

[63] Continuation of Ser. No. 41,089, Apr. 1, 1993, abandoned, which is a continuation-in-part of Ser. No. 11,665, Jan. 29, 1993, abandoned.

[51] Int. Cl.[6] ..... A63B 23/04

[52] U.S. Cl. ..... 482/79; 482/91; 482/907

[58] Field of Search ..... 482/79, 80, 91, 482/105, 140, 145, 146, 907; 297/423.1, 423.39, 423.41

[56] References Cited

U.S. PATENT DOCUMENTS

| | | | |
|---|---|---|---|
| 1,079,606 | 11/1913 | Boonet | 297/423.4 X |
| 1,232,223 | 7/1917 | Clarke | 297/423.4 X |
| 1,509,793 | 9/1924 | Thompson | 482/79 |
| 1,664,664 | 4/1928 | Crum | 482/79 |
| 1,798,472 | 3/1931 | Kelly | 297/423.41 X |
| 2,240,228 | 4/1941 | Schall | 482/140 |
| 2,374,730 | 5/1945 | Catlin | 482/80 X |
| 2,551,701 | 5/1951 | Prentice | 297/423.4 X |
| 3,284,817 | 11/1966 | Landwirth | 297/423.41 X |
| 3,297,320 | 1/1967 | Benedetto | 482/148 |
| 3,598,404 | 8/1971 | Bowman | 482/80 |
| 3,741,540 | 6/1973 | Shimizu | 482/80 |
| 4,573,678 | 3/1986 | Lamb et al. | 482/907 X |
| 4,629,180 | 12/1986 | Kaya | 482/140 |
| 4,693,470 | 9/1987 | Ogawa | 482/79 |
| 4,739,986 | 4/1988 | Kucharik et al. | 482/79 |
| 4,910,818 | 3/1990 | Orabill et al. | 297/423.41 X |
| 4,967,736 | 11/1990 | Spitzer | 128/25 B |
| 4,968,029 | 11/1990 | Cossin | 482/142 |
| 5,035,421 | 7/1991 | Scheller | 482/79 |
| 5,046,487 | 9/1991 | Scott | 128/25 B |
| 5,284,465 | 2/1994 | Homan, Jr. | 482/79 X |

FOREIGN PATENT DOCUMENTS

| | | | |
|---|---|---|---|
| 584353 | 10/1959 | Canada | 297/423.41 |
| 2491341 | 4/1982 | France | 482/142 |
| 2554356 | 5/1985 | France | 482/904 |
| 2145884 | 4/1980 | Germany | 482/904 |
| 3616970 | 11/1987 | Germany | 297/423.41 |
| 8803825 | 6/1988 | WIPO | 482/145 |

OTHER PUBLICATIONS

The Jumper (Advertisement), 1981, *Coach & Athlete* (Mar.), 31.

*Primary Examiner*—Richard J. Apley
*Assistant Examiner*—John Mulcahy
*Attorney, Agent, or Firm*—Flehr, Hohbach, Test, Albritton & Herbert

[57] ABSTRACT

A calf muscle exercise device includes a base having a surface, inclined at about 35° from horizontal, for supporting a user's feet, and a retainer for holding the user's feet on the inclined surface, with the user's toes pointing downwards. The method of using the exercise device is to position the user's feet on the inclined surface with the toes pointing downwards, to secure the feet against the inclined surface so as to leave the heels free to move, and then for the user to raise and lower their heels.

6 Claims, 4 Drawing Sheets

FULL CONTRACTION CALF MUSCLE EXERCISER

This is a continuation of application Ser. No. 08/041,089 filed Apr. 1, 1993, now abandoned, which is a continuation-in-part of application Ser. No. 08/011,665, filed Jan. 29, 1993, now abandoned.

BACKGROUND OF THE INVENTION

This invention relates generally to exercise equipment. More specifically, the invention relates to a calf muscle exercise device.

A variety of conventional exercises are known for working out the calf muscle; these are divided into two main types. The first type of calf muscle exercise involves positioning the feet on the floor or other flat surface and then raising the heels above the surface and then lowering them. This exercises the calf muscle through a range of contraction. The second type of calf muscle exercise involves positioning the feet on a step or other type of ledge, and then lowering the heels beneath the level of the ledge and then raising them. This exercises the calf muscle through a range of extension and stretches the calf muscle.

These techniques provide moderate levels of exercise for the calf muscle, but a more efficient and thorough technique would be preferred.

SUMMARY OF THE INVENTION

The present invention provides an improved method and device for exercising the calf muscle, so as to efficiently and thoroughly exercise the calf muscle up to essentially full contraction. A calf muscle exercise device according to the present invention includes a base having an inclined surface for supporting a user's feet. The inclination can range from about 20° to about 55° from horizontal, preferably about 35° from horizontal.

According to one aspect of the present invention, a user can position their feet against the inclined surface, with the portion of the foot from the heel to at least about the ball of the foot being against the inclined surface. With the feet positioned in this manner the user may then perform squat exercises, either with or without weights, to exercise the calf muscle. According to another aspect of the present invention, the user can position their feet with their heels on the floor, or other horizontal support surface, and with their toes and front portions of their feet against the inclined surface, pointing up. With the feet positioned in this manner, squat exercises can be performed either with or without weights, to exercise the calf muscle in a "reverse contraction" manner.

A calf muscle exercise device according to yet another aspect of the present invention also has a retainer for holding at least the balls of the user's feet on the inclined surface. The method of using this exercise device is to position the user's feet on the inclined surface with the toes pointing downwards, to secure the feet against the inclined surface so as to leave the heels free to move, and then for the user to raise and lower their heels. Exercising the calf muscle from an inclined surface in this manner brings the calf muscle into substantially full contraction, and causes the user's weight to be shifted to the big toe of the foot, which both cause the calf muscle to be worked out and developed in a more efficient and thorough manner.

A further understanding of the nature and advantages of the invention may be realized by reference to the remaining portions of the specification and the drawings.

DETAILED DESCRIPTION OF PREFERRED EMBODIMENTS

Figure 1:
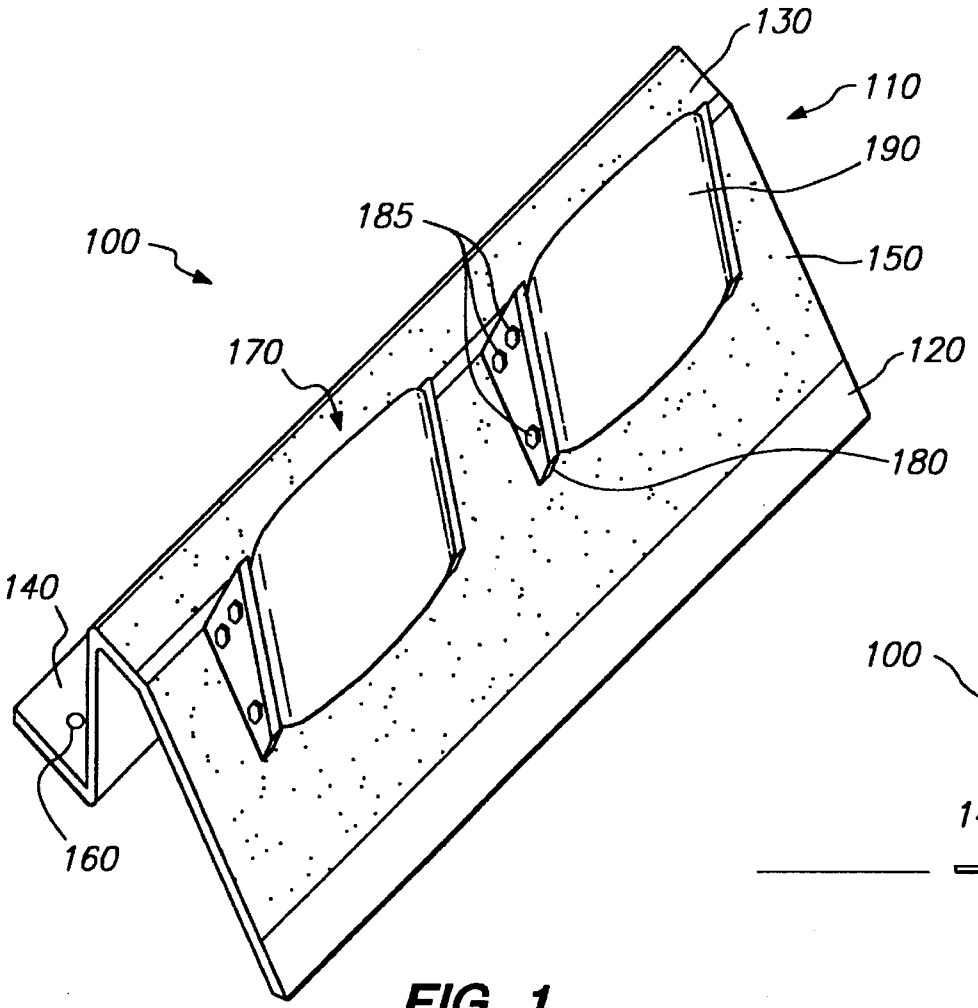
FIG. 1 shows a perspective view of a particular embodiment of a calf muscle exercise device according to one aspect of the present invention.

A preferred embodiment of a calf muscle exercise device according to the present invention is illustrated in FIG. 1. Calf muscle exerciser 100 has a steel plate base 110, which includes an inclined support surface 120, an upper horizontal surface 130, and a horizontal securement flange 140. Inclined support surface 120 and upper horizontal surface 130 are substantially covered by a high friction, non-slip, surface layer 150, to improve traction and prevent slipping of the user's feet during use. Securement flange 140 has two holes 160 which may be used to bolt calf exerciser 100 to the floor and thus secure it firmly in place, again to eliminate slipping during use. Attached to inclined surface 120 are two foot retainers 170, which hold the user's feet in place during exercise. Foot retainers 170 include steel side brackets 180 and bolts 185 that hold a rubber strap 190 in place.

Figure 2:
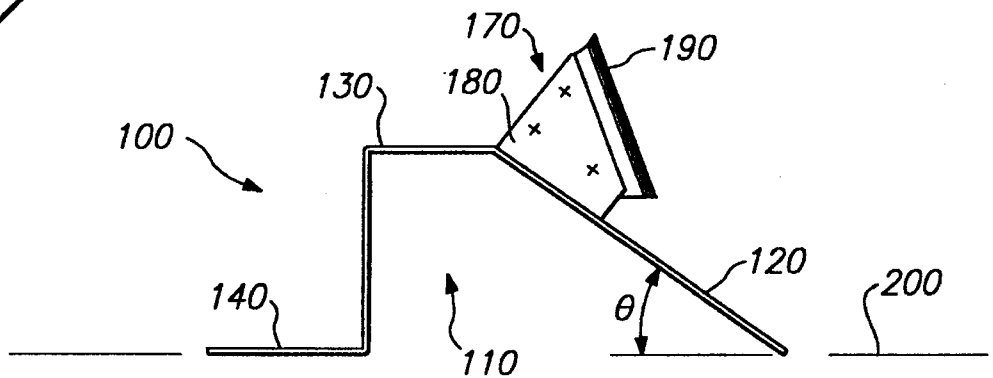
FIG. 2 shows a side view of the calf muscle exercise device of FIG. 1.

A side view of calf muscle exercise device 100 is illustrated in FIG. 2. This side view shows the angle θ formed between inclined surface 120 and a horizontal surface or floor 200. In the embodiment shown, angle θ is 35°. In general, angle θ should be between about 20° and about 55°, more preferably between about 30° and about 40°, and most preferably about 35°. Also, in the particular embodiment shown, horizontal surface 130 is about 4¼ inches high from floor 200, and is about 2½ inches wide.

Figure 3:
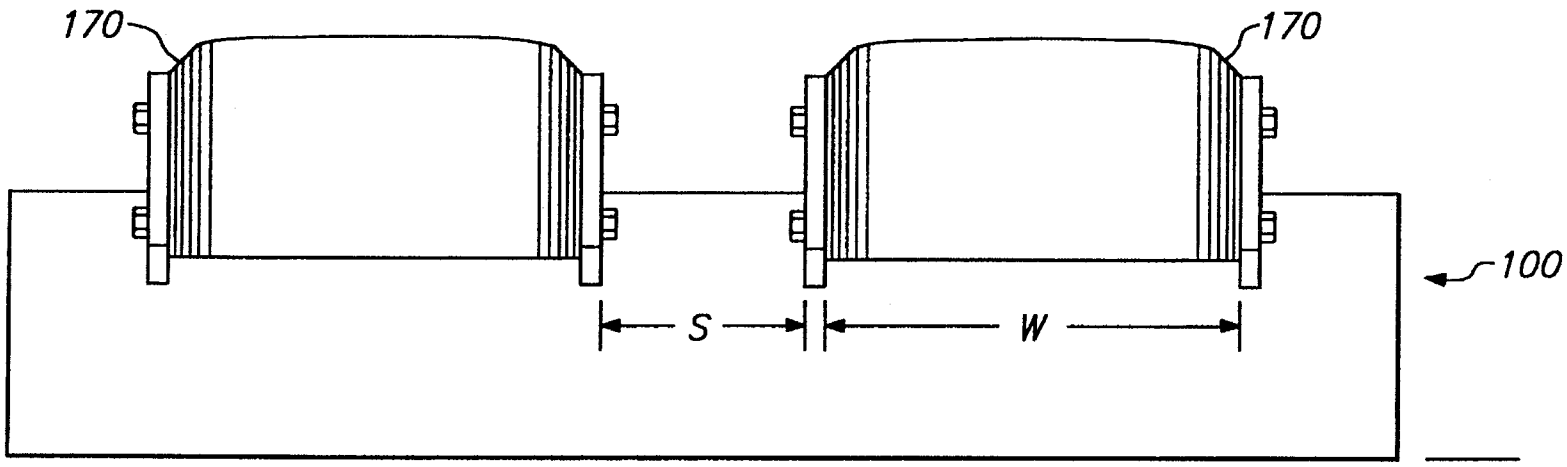
FIG. 3 shows a front view of the calf muscle exercise device of FIG. 1.
Figure 4:
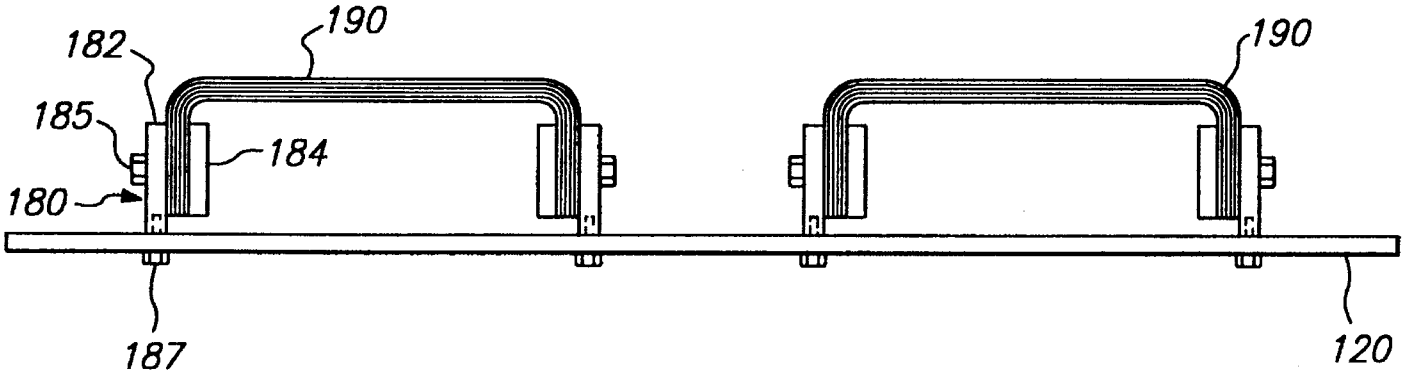
FIG. 4 shows a cross sectional view of the calf muscle exercise device of FIG. 1.

FIG. 3 shows a front view of calf muscle exercise device 100. Foot retainers 170 should be spaced apart a comfortable distance, and be of sufficient width to comfortable accommodate large feet. In the preferred embodiment of FIG. 3, foot retainers 170 are separated by distance s of about 4 inches, and have a width w of about 6 inches. FIG. 4 shows a cross sectional view corresponding to the front view of calf muscle exercise device 100 of FIG. 3, and illustrates the construction of foot retainers 170. As shown, at each end of a foot retainer 170, strap 190 is secured between an outer bracket 182 and an inner bracket 184 by bolts 185. Outer bracket 182 is in turn secured to inclined surface 120 by two bolts 187.

Figure 5:
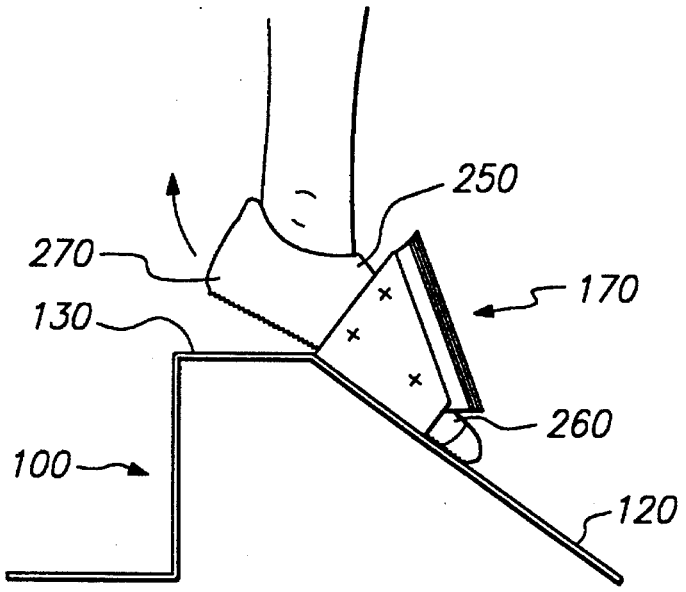
FIG. 5 shows a side view of the calf muscle exercise device of FIG. 1 being used by a person.

The deployment of device 100 by a user is illustrated in FIG. 5. The user's feet 250 are placed on surface 120 and inserted into foot retainers 170 so as to keep the users feet from sliding down inclined surface 120. Foot retainers 170 hold the front part of the user's feet, and preferably hold at least balls 260 of the feet against surface 120. Positioning the feet in this manner tends to shift weight to the big toes of the feet, which improves the effectiveness of the exercise.

The user then raises heels 270 of their feet, as indicated by the arrow, preferably lifting the heels high enough so that the calf muscle is fully contracted, and then lowers their heels, possibly to rest them on surface 130. This is repeated a number of times to form a set, according to the particular exercise routine selected by the user.

As alternative uses for exerciser 100, the user may position their feet as described above and then perform squats, but preferably without holding any additional weights as with normal squats. Also, upper horizontal surface 130 may be employed as a ledge for the stretching type calf exercise described above.

Figure 6:
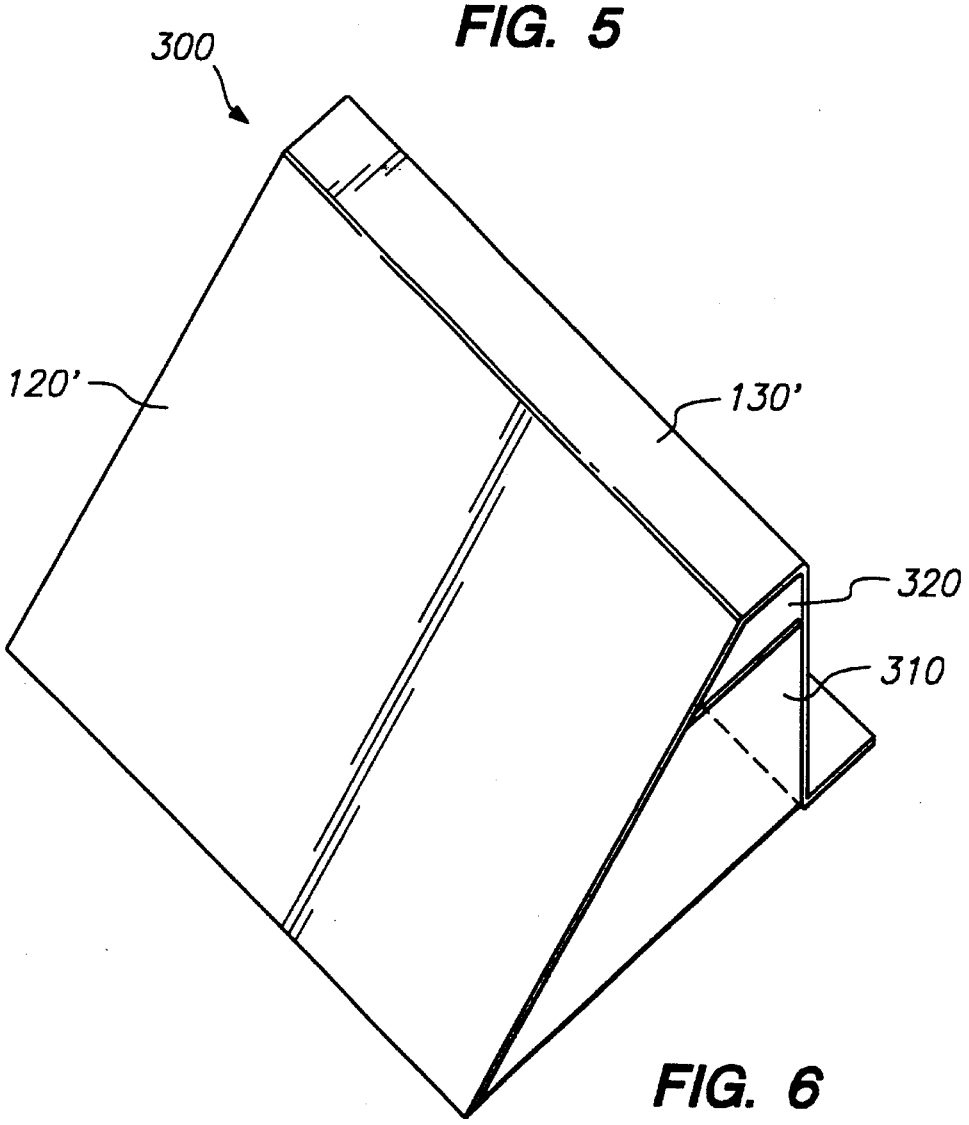
FIG. 6 shows a perspective view of a particular embodiment according to another aspect of the present invention.

The calf muscle exercise device 300 illustrated in FIG. 6 is adapted towards use with weights, so as to increase the bulk of the calf muscle, as opposed to the device of FIG. 1 which is used primarily to improve the strength and conditioning of the calf muscle. Device 300 is similar to device 100 of FIG. 1 and has an inclined support surface 120' provided with grit paper or some other high friction surface, and an upper horizontal surface 130'. Device 300 is about 6 inches high, and upper horizontal surface 130' is about 2½ inches wide. The manner of use for device 300 is for a user to position their feet against inclined surface 120', with the portion of the foot from the heel to at least about the ball of the foot being against the inclined surface. With the feet positioned in this manner the user may then perform squat exercises, either with or without weights, to exercise the calf muscle. A typical user might need to start with their toes on the floor, and as their conditioning and balance improve, move to having their entire foot against the inclined surface. Device 300 is particularly designed for use with weights, and equipped on each side with trapezoidal side support plates 310 for providing support to inclined surface 120' when weights are employed by the user. A gap of roughly two inches is provided between upper horizontal surface 130' and the top of support plate 310 to provide a handhold when moving the device. According to another aspect of the present invention, the user can position their feet with their heels on the floor, or other horizontal support surface, and with their toes and front portions of their feet against the inclined surface, pointing up. With the feet positioned in this manner, squat exercises can be performed either with or without weights, to exercise the calf muscle in a "reverse contraction" manner.

Figure 7:
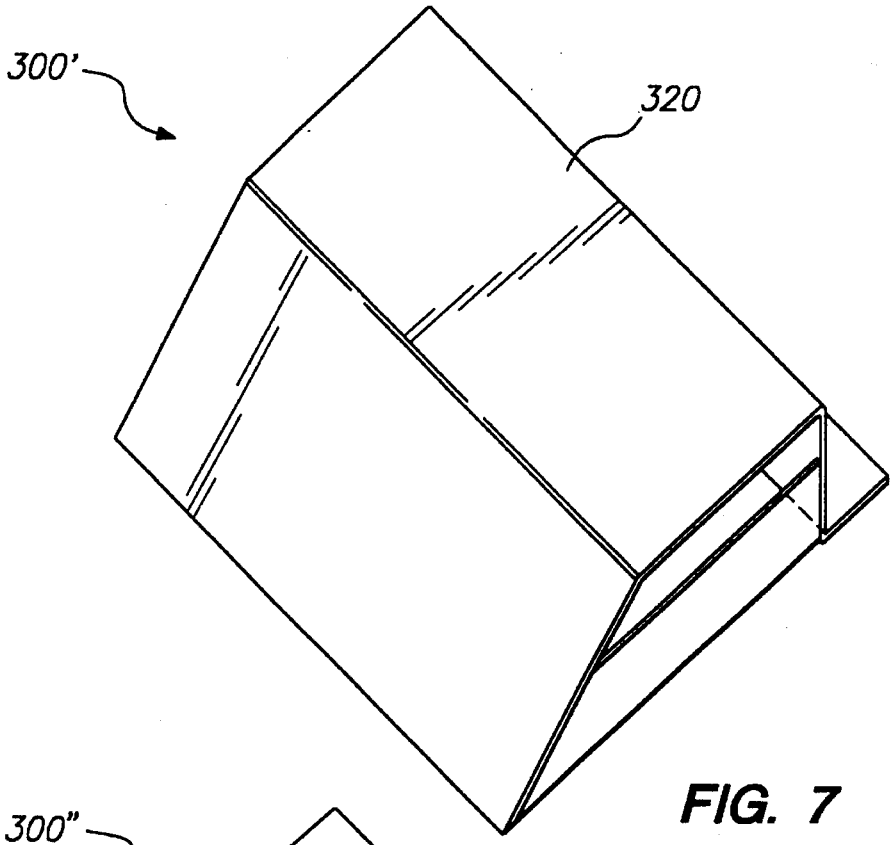
FIG. 7 shows a perspective view of a particular embodiment according to another aspect of the present invention.
Figure 8:
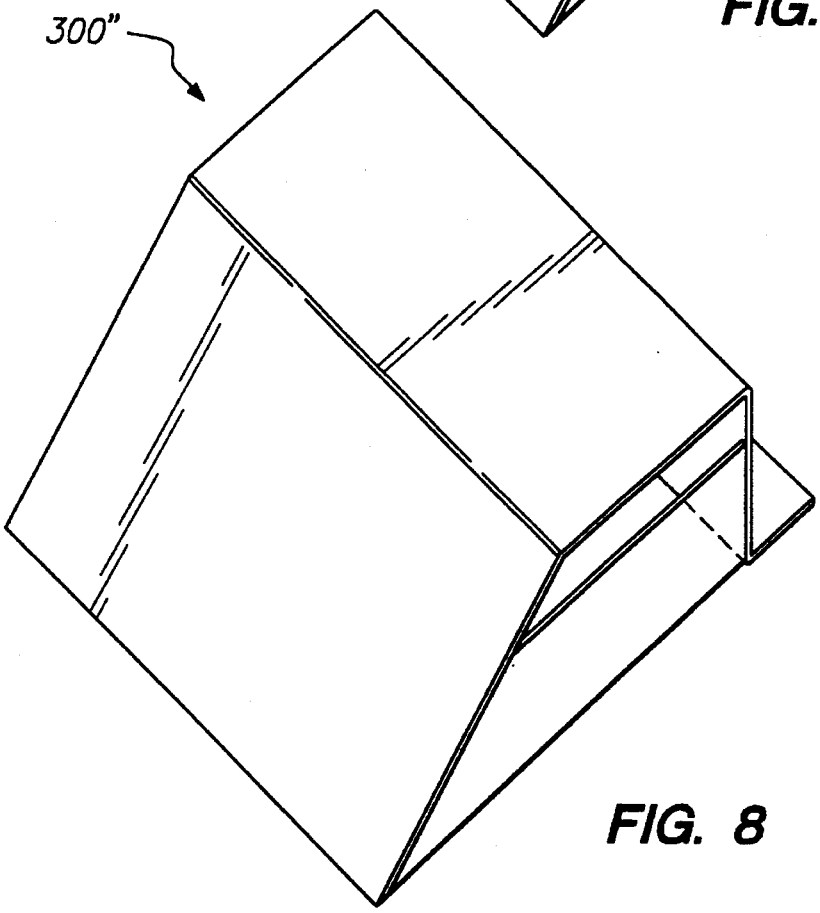
FIG. 8 shows a perspective view of a particular embodiment according to yet another aspect of the present invention.

Alternative embodiments of the device of FIG. 6 are illustrated in FIGS. 7 and 8. The device 300' of FIG. 7 differs from the device 300 of FIG. 6 in that device 300' has an upper horizontal surface 320 that is about one foot wide, to accommodate exercises in which the user would stand on upper horizontal surface 320 holding weights and then leaning over to lower the weights to the level of horizontal surface 320 or to the floor. Device 300" of FIG. 8 differs from device 300' in that device 300' is about eight inches tall, so that even people with very large feet can position their entire foot against the inclined surface when exercising.

It is to be understood that the above description is intended to be illustrative and not restrictive. Many variations and equivalents will be apparent to those of skill in the art upon reviewing the above description. For example, the base of the exercise device could be made of wood, plastic, or a variety of other materials. The foot retaining means could employ flexible straps of leather or other material rather than rubber, or could instead be formed of a relatively inflexible material. The scope of the invention should, therefore, be determined with reference to the appended claims, along with the full scope of equivalents to which such claims are entitled.

What is claimed is:

1. A calf muscle exercise device for facilitating full contraction of a user's calf muscle, comprising:

a base configured to support full weight of the user;

an inclined surface attached to and supported by said base and extending upwardly from said base where a lower portion of said inclined surface is configured to accommodate a ball of the user's foot, said inclined surface extending upwardly to an upper horizontal surface of a size sufficient to accommodate a heel of the user's foot, said upper horizontal surface also supported by said base, said inclined surface forming a fixed angle of about 35° relative to the floor and having a rough high friction surface, wherein said inclined surface is sufficiently rigid to support the user's full weight during an exercise while substantially maintaining said fixed angle; and a retainer to retain the ball of the user's foot against said lower portion of said inclined surface and to permit the heel of the user's foot to extend over said upper horizontal surface.

2. The calf muscle exercise device of claim 1, wherein said retainer is a strap.

3. A calf muscle exercise device for facilitating full contraction of a user's calf muscle, comprising:

a base having a first end and a second end, said base configured to support the full weight of the user;

a fixed and rigid inclined surface attached to said base and supported by said base, said inclined surface having a first portion attached to said first end at a first distance from the base, said first portion configured to accommodate a ball of the user's foot, said inclined surface further having a second portion attached to said second end at a second distance from the base greater than said first distance, said second portion configured to accommodate a heel of the user's foot and including a horizontal surface, and said inclined surface configured to support the full weight of the user during an exercise; and a retainer to retain the ball of the user's foot against said first portion of said inclined surface.

4. The calf muscle exercise device of claim 3, wherein said retainer is a strap.

5. A calf muscle exercise device for facilitating full contraction of a user's calf muscle, comprising:

a base configured to support the full weight of the user;

an inclined surface attached to mad supported by said base and extending upwardly from said base to an upper horizontal surface also supported by said base, said upper horizontal surface being of a size sufficient to accommodate a heel of the user's foot, said inclined surface forming a fixed angle of about 35° relative to the floor and having a high friction surface, wherein said inclined surface is sufficiently rigid to support the user's weight during an exercise while substantially maintaining said fixed angle; and a retainer attached to said inclined surface and configured to retain the ball of the user's foot against a portion of said inclined surface and to permit the heel of the user's foot to extend over said upper horizontal surface.

6. The calf muscle exercise device of claim 5, wherein said retainer is a strap.

* * * * *

UNITED STATES PATENT AND TRADEMARK OFFICE

CERTIFICATE OF CORRECTION

PATENT NO. : 5,558,606
DATED : Sep. 24, 1996
INVENTOR(S) : Richard D. Poncini

It is certified that error appears in the above-identified patent and that said Letters Patent is hereby corrected as shown below:

The title page should be deleted to appear as per attached title page.

Signed and Sealed this

Twenty-third Day of June, 1998

*Attest:*

*Attesting Officer*

BRUCE LEHMAN

*Commissioner of Patents and Trademarks*

United States Patent [19]

Poncini

[11] Patent Number: 5,558,606

[45] Date of Patent: Sep. 24, 1996

[54] FULL CONTRACTION CALF MUSCLE EXERCISER

[76] Inventors: Richard D. Poncini, 2902 Alameda Avenue, Half Moon Bay, California 94019

[21] Appl. No.: 271,254

[22] Filed: Jul. 7, 1994

Related U.S. Application Data

[63] Continuation of Ser. No. 41,089, Apr. 1, 1993, abandoned, which is a continuation-in-part of Ser. No. 11,665, Jan. 29, 1993, abandoned.

[51] Int. Cl.[6] ..... A63B 23/04

[52] U.S. Cl. ..... 482/79; 482/91; 482/907

[58] Field of Search ..... 482/79, 80, 91, 482/105, 140, 145, 146, 907; 297/423.1, 423.39, 423.41

[56] References Cited

U.S. PATENT DOCUMENTS

| | | | |
|---|---|---|---|
| 1,079,606 | 11/1913 | Boonet | 297/423.4 X |
| 1,232,223 | 7/1917 | Clarke | 297/423.4 X |
| 1,509,793 | 9/1924 | Thompson | 482/79 |
| 1,664,664 | 4/1928 | Crum | 482/79 |
| 1,798,472 | 3/1931 | Kelly | 297/423.41 X |
| 2,240,228 | 4/1941 | Schall | 482/140 |
| 2,374,730 | 5/1945 | Catlin | 482/80 X |
| 2,551,701 | 5/1951 | Prentice | 297/423.4 X |
| 3,284,817 | 11/1966 | Landwirth | 297/423.41 X |
| 3,297,320 | 1/1967 | Benedetto | 482/148 |
| 3,598,404 | 8/1971 | Bowman | 482/80 |
| 3,741,540 | 6/1973 | Shimizu | 482/80 |
| 4,573,678 | 3/1986 | Lamb et al. | 482/907 X |
| 4,629,180 | 12/1986 | Kaya | 482/140 |
| 4,693,470 | 9/1987 | Ogawa | 482/79 |
| 4,739,986 | 4/1988 | Kucharik et al. | 482/79 |
| 4,910,818 | 3/1990 | Orabill et al. | 297/423.41 X |
| 4,967,736 | 11/1990 | Spitzer | 128/25 B |
| 4,968,029 | 11/1990 | Cossin | 482/142 |
| 5,035,421 | 7/1991 | Scheller | 482/79 |
| 5,046,487 | 9/1991 | Scott | 128/25 B |
| 5,284,465 | 2/1994 | Homan, Jr. | 482/79 X |

FOREIGN PATENT DOCUMENTS

| | | | |
|---|---|---|---|
| 584353 | 10/1959 | Canada | 297/423.41 |
| 2491341 | 4/1982 | France | 482/142 |
| 2554356 | 5/1985 | France | 482/904 |
| 2145884 | 4/1980 | Germany | 482/904 |
| 3616970 | 11/1987 | Germany | 297/423.41 |
| 8803825 | 6/1988 | WIPO | 482/145 |

OTHER PUBLICATIONS

The Jumper (Advertisement), 1981, *Coach & Athlete* (Mar.), 31.

*Primary Examiner*—Richard J. Apley
*Assistant Examiner*—John Mulcahy
*Attorney, Agent, or Firm*—Flehr, Hohbach, Test, Albritton & Herbert

[57] ABSTRACT

A calf muscle exercise device includes a base having a surface, inclined at about 35° from horizontal, for supporting a user's feet, and a retainer for holding the user's feet on the inclined surface, with the user's toes pointing downwards. The method of using the exercise device is to position the user's feet on the inclined surface with the toes pointing downwards, to secure the feet against the inclined surface so as to leave the heels free to move, and then for the user to raise and lower their heels.

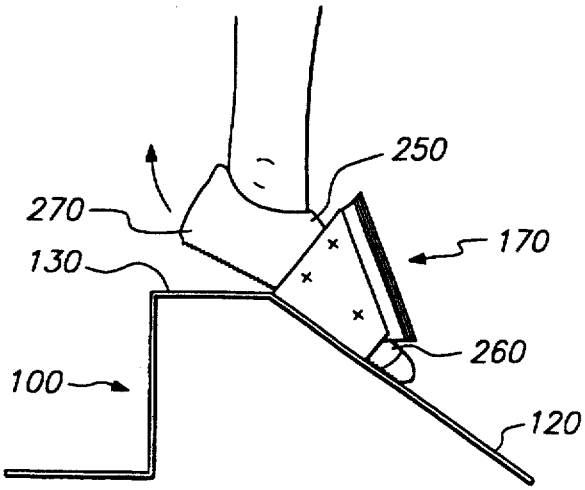

6 Claims, 4 Drawing Sheets